United States Patent [19]

French

[11] Patent Number: 4,947,082

[45] Date of Patent: Aug. 7, 1990

[54] SEALING ARRANGEMENT FOR A LAMP HOUSING

[75] Inventor: Alan P. French, Farmdale, Ohio

[73] Assignee: General Motors Corporation, Detroit, Mich.

[21] Appl. No.: 319,592

[22] Filed: Mar. 6, 1989

[51] Int. Cl.[5] ..... H01R 4/48; H01R 9/09

[52] U.S. Cl. ..... 313/318; 439/77; 439/602

[58] Field of Search ..... 313/318; 439/77, 271, 439/280, 329, 556, 562, 587, 602, 611, 617

[56] References Cited

U.S. PATENT DOCUMENTS

| | | | |
|---|---|---|---|
| 2,860,233 | 11/1958 | Johnson, Jr. | 439/602 X |
| 4,005,924 | 2/1977 | Nestor | 439/77 X |
| 4,593,958 | 6/1986 | Baba | 439/77 |

*Primary Examiner*—Kenneth Wieder

*Attorney, Agent, or Firm*—Edward J. Biskup

[57] ABSTRACT

A sealing arrangement for a flexible printed circuit fixed to a lamp housing and feeding electrical current to a lamp bulb assembly connected to the lamp housing characterized in that the lamp housing and the lamp socket assembly each support a sealing gasket which engages the flexible printed circuit outboard of the electrical connection between the terminals of the lamp socket assembly and the printed circuit.

3 Claims, 2 Drawing Sheets

SEALING ARRANGEMENT FOR A LAMP HOUSING

This invention relates to lamp assemblies and more particularly concerns a sealing arrangement for a lamp socket assembly that is supported within the housing of a lamp assembly.

Stated broadly the sealing arrangement according to the present invention is incorporated in a lamp housing having a lamp socket assembly mounted therein that supports a flexible printed circuit for providing electrical current to the lamp bulb contained in the lamp socket assembly. The lamp housing and the lamp socket assembly each support an annular gasket which engages the flexible printed circuit outboard of the electrical connection between the lamp socket assembly and the flexible printed circuit so as to seal the electrical connection from the weather on both sides of the printed circuit.

In the preferred form, the sealing arrangement is adapted to be connected to a tail lamp housing which is provided with a socket opening at the rear end thereof. A printed circuit is fixed to the rear of the lamp housing and has an electrically conductive contact member adjacent to the socket opening. An annular groove is formed in the lamp housing surrounding the socket opening outboard of the contact member. The lamp socket assembly includes a body portion supporting a terminal member which is adapted to make electrical contact with the contact member on the printed circuit when the lamp socket assembly is inserted into the socket opening. In addition, the body portion of the lamp socket assembly has an annular seating surface located outboard of the terminal member facing the portion of the socket assembly that is insertable into the socket opening. A first annular gasket is located on the seating surface of the lamp socket assembly and a second annular gasket is located in the annular groove in the housing so when the lamp socket assembly is inserted into the socket opening, the first and second gaskets engage both sides of the printed circuit and seal the terminal member and the contact pad from all weather conditions.

The objects of the present invention are to provide a new and improved sealing arrangement for a lamp socket assembly mountable in a lamp housing provided with a flexible printed circuit; to provide a new and improved sealing arrangement for a lamp housing having a lamp socket assembly mounted therein and which supports a flexible printed circuit for providing electrical current to the lamp socket assembly and characterized in that a pair of gaskets are located on opposite sides of the printed circuit surrounding the socket opening of the lamp socket assembly; and to provide a new and improved sealing arrangement for a lamp socket assembly which is energized through a flexible printed circuit fixed to a lamp housing and provided with a socket opening that is surrounded by an annular groove which retains a sealing gasket that cooperates with a sealing gasket on the lamp socket assembly to seal the electrical contact areas of the flexible printed circuit on the opposite sides thereof.

Other objects and advantages of the present invention will be apparent from the following detailed description when taken with the drawings in which.

Figure 1:
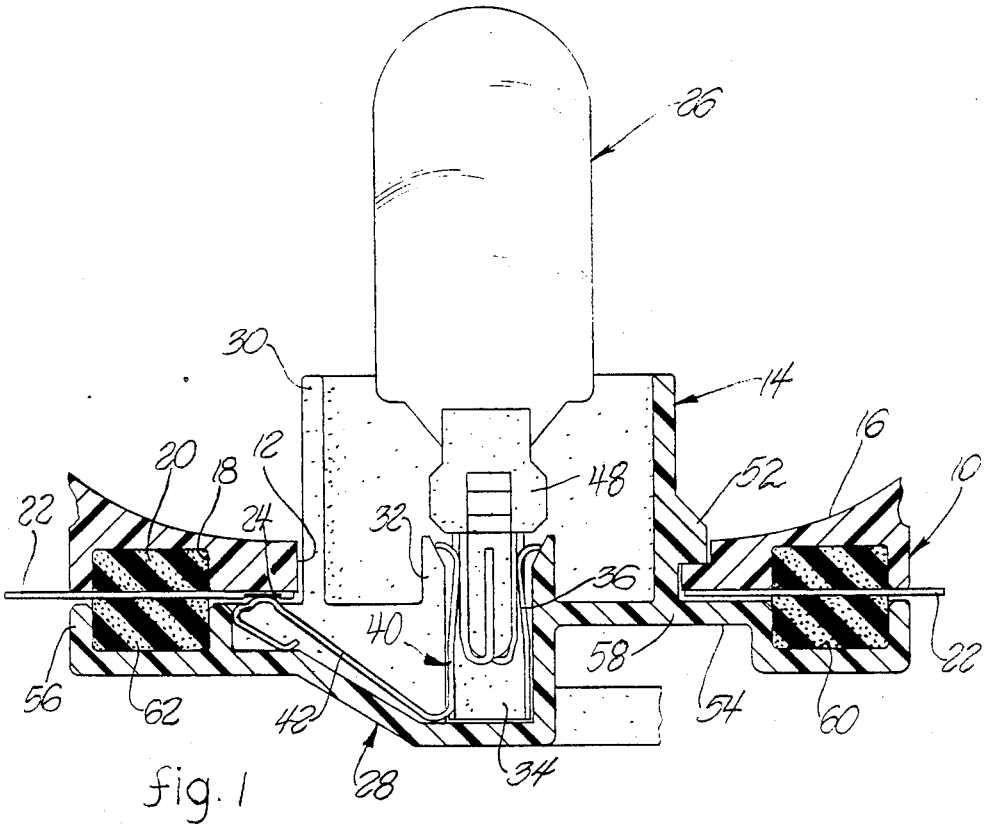
FIG. 1 is a cross-sectional view of a sealing arrangement according to the present invention for a lamp housing provided with a flexible printed circuit which provides electrical current to a lamp socket assembly mounted to the lamp housing.

Referring to the drawings and more particularly FIG. 1 thereof, a sectional view of a sealing arrangement according to the present invention is shown employed with a lamp housing 10 having a circular socket opening 12 formed in the rear end thereof that serves to accommodate a lamp socket assembly 14 having conventional twist lock features such as those incorporated with the socket bulb assembly seen in U.S. Pat. 4,019,045 issued on Apr. 19, 1977 and assigned to the assignee of this invention.

More specifically, the lamp housing 10 forms a part of a tail lamp assembly of a motor vehicle where the rear portion may be located in an expose position subject to all weather conditions thereby requiring an effective seal between the lamp socket assembly 14 and the lamp housing 10. In this case, only the lamp sock assembly support portion of the lamp housing 10 is shown having a parabolic reflecting surface 16 at its front end, the central portion of which is formed with the socket opening 12. The rear end of the lamp housing 10 adjacent the socket opening 12 is formed with an annular groove 18 which is concentric with the socket opening 12. The groove 18 has a ring-like sealing gasket 20 located therein for purposes which will be hereinafter explained. The rear end of the lamp housing 10 also has a flexible printed circuit member 22 fixed thereto which has three circumferentially spaced and exposed electrically conductive contact members (one of which only is shown and indicated by reference numeral 24) formed thereon surrounding the socket opening 12. One of the contact members provides electrical current to the running light filament of the lamp bulb 26, another to the brake light filament of the lamp bulb 26, while the third contact member leads to ground.

Figure 2:
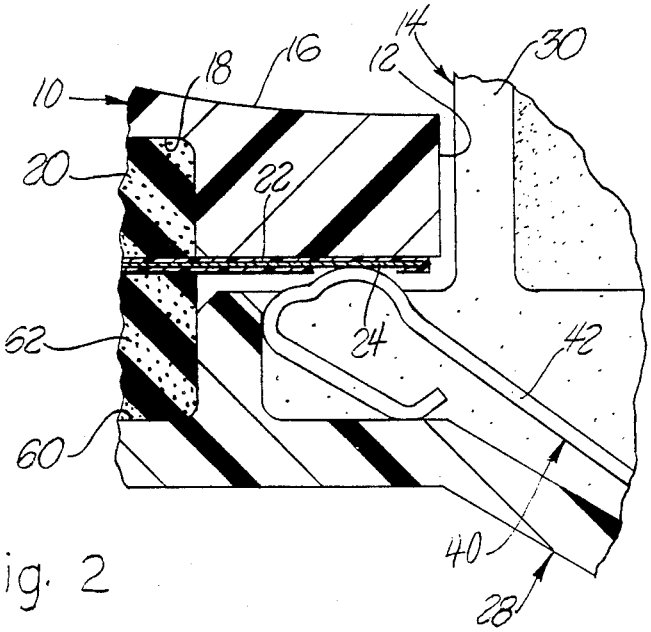
FIG. 2 is an enlarged view of one of the electrical connections between the contact member of the flexible printed circuit and one of the terminal members of the lamp socket assembly seen in FIG. 1.
Figure 3:
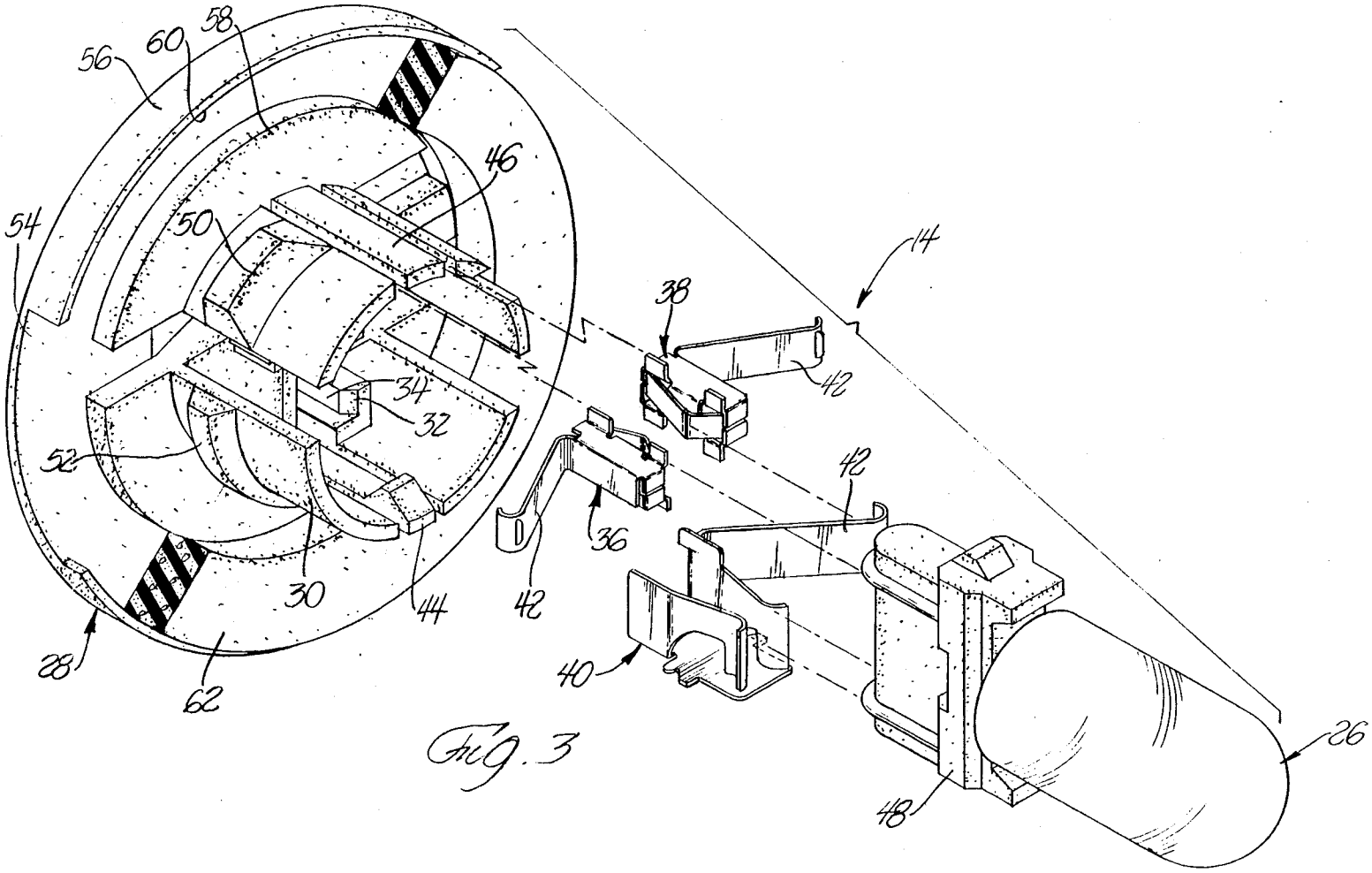
FIG. 3 is an exploded perspective view of the lamp socket assembly shown in FIG. 1.

As seen in FIGS. 1 and 3, the lamp socket assembly 14 includes a socket body 28 having a tubular portion 30, the lower central portion of which is formed with a base 32 provided with an elongated rectangular opening 34. The opening 34 supports a pair of power feed terminals 36 and 38 and a ground terminal 40 which are electrically connected to the terminals of the lamp bulb 26 which is of the type identified in the trade as a wedge-type lamp bulb. As seen in FIGS. 1 and 2 of the drawings, ground terminal 40 is shown having a contact arm 42, which makes contact with the exposed power contact member 24 formed on the flexible printed circuit 22 when the lamp bulb assembly 14 is locked to the lamp housing 10. As seen in FIG. 3, appropriate diametrically opposed flexible lock members 44 and 46 are formed with the tubular portion 30 for cooperation with the base 48 of the lamp bulb 26 for retaining the lamp bulb 26 within the socket body 28.

As aforementioned, the lamp socket assembly 14 includes conventional twist lock features for maintaining the lamp socket assembly 14 within the socket opening 12 formed in the housing 10. In this regard, and although not shown, the socket opening 12 is provided with two identical circumferentially spaced radially outwardly directed clearance slots and a third indexing and clearance slot of greater arcuate extent than the identical slots. The slots of the socket opening 12 define an indexed array so that the tubular portion 30 of socket body 28 will fit only one way axially through the socket opening 12. Three retention ears, two of which only are shown in FIG. 3 and indicated by reference numeral 50 and 52, are formed on the outer periphery of the tubular portion 30 and extend axially beyond a ring-like flange 54 integrally formed with the tubular portion 30. The retention ears conform in configuration to the aforementioned slots in the socket opening 12 and are similarly circumferentially spaced from each other. The outer portion of the flange 54 is formed with a rim 56 which together with an inner circular section 58 integral with the tubular portion 30 defines an annular groove 60 which accommodates a ring-like sealing gasket 62.

Thus, during installation of the lamp socket assembly 14 into the socket opening of the lamp housing 10, the retention ears on the tubular portion 30 are first axially aligned with the associated slots in the socket opening 12 after which the lamp socket assembly 14 is moved axially into the socket opening 12 until the retention ears are located axially inwardly of the inner lock surface formed on the inside of the lamp housing 10. The lamp socket assembly 14 is then rotated clockwise to a locked position during which time the retention ears pull the sealing gasket 62 into sealed relationship with outer surface of the flexible printed circuit 22 and at the same time cause the gasket 20 to firmly engage and be pressed into a sealed relationship with the inner surface of the printed circuit 22. The locked position of the lamp socket assembly 14 can be attained when one of the retention ears engage a stop formed on the lamp housing 10.

From the above description, it should be apparent that once the lamp socket assembly 14 is locked in the socket opening 12, the contact arms 42 formed with the power feed terminals 36 and 38 and the ground terminal 40 of the lamp socket assembly 14 will make contact with the three exposed contact members on the outer surface of the flexible printed circuit 22 surrounding socket opening 12. In addition, the sealing gasket 62 on the lamp bulb assembly 14 cooperates with the sealing gasket 20 of the lamp housing 10 to trap the flexible printed circuit 22 therebetween and seal the contact members and contact arms 42 from road splash, dust, and moisture that may enter the inside of the lamp housing from either side of the printed circuit 22.

Various changes and modifications can be made in the construction without departing from the spirit of the invention. Such changes and modifications are contemplated by the inventor and he does not wish to be limited except by the scope of the appended claims.

The embodiments of the invention in which an exclusive property or privilege is claimed are defined as follows:

1. In combination with a lamp housing having a lamp socket assembly mounted therein and supporting a flexible printed circuit for providing electrical current to a lamp bulb contained in said lamp socket assembly, the improvement wherein said lamp housing and said lamp socket assembly each independently support an annular gasket which engages the flexible printed circuit outboard of an electrical connection between said lamp socket assembly and said flexible printed circuit so as to seal said electrical connection from dust and moisture at opposite sides of said printed circuit.

2. A sealing arrangement for a lamp socket assembly adapted to be connected to a lamp housing provided with a socket opening at the rear end thereof, a printed circuit fixed to the rear of said lamp housing and having an electrically conductive contact member adjacent said socket opening, a first annular seating surface formed on said lamp housing at said rear end thereof and surrounding said socket opening outboard of said contact member, said lamp socket assembly including a body portion supporting a terminal member adapted to make electrical contact with said contact member when said lamp socket assembly is inserted into said socket opening, said body portion having a second annular seating surface located outboard of said terminal member and facing the portion of the lamp socket assembly that is insertable into said socket opening, and a first annular gasket located on said second seating surface and a second annular gasket located in said first annular seating surface of said lamp housing so when said lamp socket assembly is mounted in said socket opening, said first and second gaskets engage the opposed sides of said printed circuit and seal said contact member and said terminal member from dust and moisture.

3. A sealing arrangement for a lamp socket assembly adapted to be connected to a vehicle tail lamp housing provided with a socket opening at the rear end thereof, a flexible printed circuit fixed to the rear of said lamp housing and having at least two conductive contact members adjacent said socket opening, an annular groove formed in said lamp housing at said rear end thereof and surrounding said socket opening outboard of said contact member, said lamp socket assembly including a body portion supporting terminal members adapted to make electrical contact with said contact members when said lamp socket assembly is inserted into said socket opening, said body portion having an annular seating surface located outboard of said terminal members and facing the portion of the lamp socket assembly that is insertable into said socket opening, and a first annular gasket located on said seating surface and a second annular gasket located in said annular groove of said lamp housing so when said lamp socket is mounted in said socket opening said first and second gaskets engage the opposed sides of said printed circuit and seal said contact members and said terminal members from dust and moisture.

* * * * *